US009391367B2

(12) United States Patent
Greenberg et al.

(10) Patent No.: US 9,391,367 B2
(45) Date of Patent: Jul. 12, 2016

(54) APPARATUS, SYSTEM AND METHOD OF STEERING AN ANTENNA ARRAY

(71) Applicant: Intel Corporation, Santa Clara, CA (US)

(72) Inventors: Maxim Greenberg, Atlit (IL); Michael Genossar, Modiin (IL)

(73) Assignee: INTEL CORPORATION, Santa Clara, CA (US)

( * ) Notice: Subject to any disclaimer, the term of this patent is extended or adjusted under 35 U.S.C. 154(b) by 778 days.

(21) Appl. No.: 13/705,235

(22) Filed: Dec. 5, 2012

(65) Prior Publication Data

US 2014/0152501 A1 Jun. 5, 2014

(51) Int. Cl.
*H01Q 3/00* (2006.01)
*H01Q 3/26* (2006.01)

(52) U.S. Cl.
CPC ..... *H01Q 3/2682* (2013.01)

(58) Field of Classification Search
CPC ..... H01Q 3/2682
USPC ..... 342/372
See application file for complete search history.

(56) References Cited

U.S. PATENT DOCUMENTS 3,680,100 A * 7/1972 Woerrlein ..... 342/13
7,429,949 B1 * 9/2008 Trigui ..... 342/372
8,009,097 B1 8/2011 Lee et al.
2002/0186919 A1 * 12/2002 Pepper ..... 385/27
2008/0102898 A1 5/2008 Na et al.
2009/0233556 A1 9/2009 Xia et al.
2010/0322337 A1 12/2010 Ylitalo et al.
2012/0087450 A1 4/2012 Coldrey et al.

OTHER PUBLICATIONS

International Search Report and Written Opinion for PCT Application No. PCT/US2013/047735, mailed on Oct. 11, 2013, 14 pages.
Wireless-Gigabit-Alliance (WGA) specifications (Wireless Gigabit Alliance, Inc. WiGig MAC and PHY Specification Version 1.0, Final specification), Apr. 2010.
IEEE Std 802.11™-2012. Part 11: Wireless LAN Medium Access Control (MAC) and Physical Layer (PHY) Specifications, IEEE Standard for Information technology. Telecommunications and information exchange between systems Local and metropolitan area networks—Specific requirements, Mar. 29, 2012.

* cited by examiner

*Primary Examiner* — Frank J McGue
(74) *Attorney, Agent, or Firm* — Shichrur & Co.

(57) ABSTRACT

Some demonstrative embodiments include apparatuses, systems and/or methods of steering an antenna array. For example, a steering controller may control steering of an antenna array, the steering controller may be configured to select a first plurality of timing taps out of a second plurality of timing taps of a channel estimation, to determine a plurality of steering vectors corresponding the first plurality of timing taps, to determine a particular steering vector based on the plurality of steering vectors, and to control steering of the antenna array according to the particular steering vector.

30 Claims, 3 Drawing Sheets

APPARATUS, SYSTEM AND METHOD OF STEERING AN ANTENNA ARRAY

BACKGROUND

An antenna array, e.g., a phased array antenna, may include a plurality of radiating antenna elements configured to simultaneously emit signals in accordance with a beamforming scheme.

For example, the phased array antenna may be controlled to form a beam directed in a particular direction, or to receive a beam from a particular direction, by shifting phases of the signals emitted by the plurality of antenna elements. The phases of the signals emitted by the antenna elements may be shifted, for example, to provide a constructive and/or destructive interference configured to steer the beam in the particular direction.

The phased array antenna may operate as a steerable antenna having a steerable beam, which may be steered to a preferred beam direction. For example, the preferred beam direction may be a direction in which received wireless communication signals are optimal, e.g., having maximal signal strength.

A wireless communication device may utilize a beamforming process to determine antenna weights to be applied to the antenna elements, e.g., to provide a maximum directional gain and/or facilitate multi-gigabit rate transmission.

The beamforming process may include performing a channel estimation using an omni-directional antenna setting at a receiver side, and determining the antenna weights based on a time tap ("tap"), which has a maximal amplitude, of a channel response of the channel estimation in a time domain.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
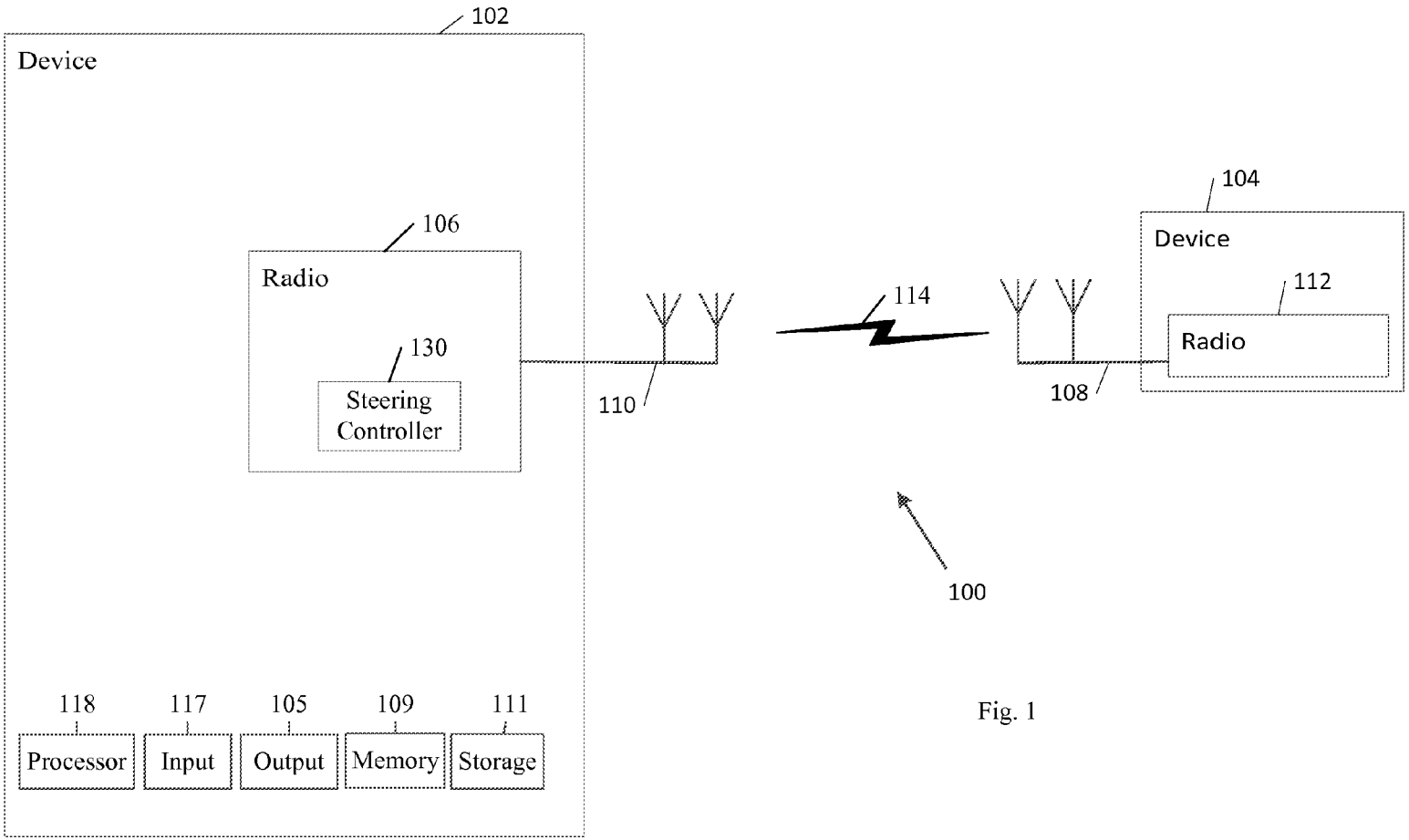
FIG. 1 is a schematic block diagram illustration of a system, in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments", etc., indicate that the embodiment(s) so described may include a particular feature, structure, or characteristic, but not every embodiment necessarily includes the particular feature, structure, or characteristic. Further, repeated use of the phrase "in one embodiment" does not necessarily refer to the same embodiment, although it may.

As used herein, unless otherwise specified the use of the ordinal adjectives "first", "second", "third" etc., to describe a common object, merely indicate that different instances of like objects are being referred to, and are not intended to imply that the objects so described must be in a given sequence, either temporally, spatially, in ranking, or in any other manner.

Some embodiments may be used in conjunction with various devices and systems, for example, a Personal Computer (PC), a desktop computer, a mobile computer, a laptop computer, a notebook computer, a tablet computer, an Ultrabook™ computer, a server computer, a handheld computer, a handheld device, a Personal Digital Assistant (PDA) device, a handheld PDA device, an on-board device, an off-board device, a hybrid device (e.g., combining cellular phone functionalities with PDA device functionalities), a vehicular device, a non-vehicular device, a mobile or portable device, a consumer device, a non-mobile or non-portable device, a wireless communication station, a wireless communication device, a wireless Access Point (AP), a wired or wireless router, a wired or wireless modem, a video device, an audio device, an audio-video (A/V) device, a wired or wireless network, a wireless area network, a Wireless Video Area Network (WVAN), a Local Area Network (LAN), a Wireless LAN (WLAN), a Personal Area Network (PAN), a Wireless PAN (WPAN), and the like.

Some embodiments may be used in conjunction with devices and/or networks operating in accordance with existing Wireless-Gigabit-Alliance (WGA) specifications (Wireless Gigabit Alliance, Inc WiGig MAC and PHY Specification Version 1.1, April 2011, Final specification) and/or future versions and/or derivatives thereof, devices and/or networks operating in accordance with existing IEEE 802.11 standards (IEEE 802.11-2012, *IEEE Standard for Information technology—Telecommunications and information exchange between systems Local and metropolitan area networks*—Specific requirements Part 11: Wireless LAN Medium Access Control (MAC) and Physical Layer (PHY) Specifications, Mar. 29, 2012; IEEE802.11 task group ac (TGac) ("IEEE802.11-09/0308r12—TGac Channel Model Addendum Document"); IEEE 802.11 task group ad (TGad) (IEEE P802.11ad *Standard for Information Technology—Telecommunications and Information Exchange Between Systems—Local and Metropolitan Area Networks*—Specific Requirements—Part 11: Wireless LAN Medium Access Control (MAC) and Physical Layer (PHY) Specifications—Amendment 5: Enhancements for Very High Throughput in the 60 GHz Band)) and/or future versions and/or derivatives thereof, devices and/or networks operating in accordance with existing WirelessHD™ specifications and/or future versions and/ or derivatives thereof, units and/or devices which are part of the above networks, and the like.

Some embodiments may be used in conjunction with one way and/or two-way radio communication systems, cellular radio-telephone communication systems, a mobile phone, a cellular telephone, a wireless telephone, a Personal Communication Systems (PCS) device, a PDA device which incorporates a wireless communication device, a mobile or portable Global Positioning System (GPS) device, a device which incorporates a GPS receiver or transceiver or chip, a device which incorporates an RFID element or chip, a Multiple Input Multiple Output (MIMO) transceiver or device, a Single Input Multiple Output (SIMO) transceiver or device, a Multiple Input Single Output (MISO) transceiver or device, a device having one or more internal antennas and/or external antennas, Digital Video Broadcast (DVB) devices or systems, multi-standard radio devices or systems, a wired or wireless handheld device, e.g., a Smartphone, a Wireless Application Protocol (WAP) device, or the like.

Some embodiments may be used in conjunction with one or more types of wireless communication signals and/or systems, for example, Radio Frequency (RF), Infra Red (IR), Frequency-Division Multiplexing (FDM), Orthogonal FDM (OFDM), Time-Division Multiplexing (TDM), Time-Division Multiple Access (TDMA), Extended TDMA (E-TDMA), General Packet Radio Service (GPRS), extended GPRS, Code-Division Multiple Access (CDMA), Wideband CDMA (WCDMA), CDMA 2000, single-carrier CDMA, multi-carrier CDMA, Multi-Carrier Modulation (MDM), Discrete Multi-Tone (DMT), Bluetooth®, Global Positioning System (GPS), Wi-Fi, Wi-Max, ZigBee™, Ultra-Wideband (UWB), Global System for Mobile communication (GSM), 2G, 2.5G, 3G, 3.5G, Long Term Evolution (LTE), LTE advanced, Enhanced Data rates for GSM Evolution (EDGE), or the like. Other embodiments may be used in various other devices, systems and/or networks.

The term "wireless device", as used herein, includes, for example, a device capable of wireless communication, a communication device capable of wireless communication, a communication station capable of wireless communication, a portable or non-portable device capable of wireless communication, or the like. In some demonstrative embodiments, a wireless device may be or may include a peripheral that is integrated with a computer, or a peripheral that is attached to a computer. In some demonstrative embodiments, the term "wireless device" may optionally include a wireless service.

The term "communicating" as used herein with respect to a wireless communication signal includes transmitting the wireless communication signal and/or receiving the wireless communication signal. For example, a wireless communication unit, which is capable of communicating a wireless communication signal, may include a wireless transmitter to transmit the wireless communication signal to at least one other wireless communication unit, and/or a wireless communication receiver to receive the wireless communication signal from at least one other wireless communication unit.

Some demonstrative embodiments may be used in conjunction with suitable limited-range or short-range wireless communication networks, for example, a wireless area network, a "piconet", a WPAN, a WVAN and the like. Other embodiments may be used in conjunction with any other suitable wireless communication network.

Some demonstrative embodiments may be used in conjunction with a wireless communication network communicating over a frequency band of 60 GHz. However, other embodiments may be implemented utilizing any other suitable wireless communication frequency bands, for example, an Extremely High Frequency (EHF) band (the millimeter wave (mmwave) frequency band), e.g., a frequency band within the frequency band of between 30 Ghz and 300 GHZ, a WLAN frequency band, a WPAN frequency band, a frequency band according to the WGA specification, and the like.

The term "antenna", as used herein, may include any suitable configuration, structure and/or arrangement of one or more antenna elements, components, units, assemblies and/or arrays. In some embodiments, the antenna may implement transmit and receive functionalities using separate transmit and receive antenna elements. In some embodiments, the antenna may implement transmit and receive functionalities using common and/or integrated transmit/receive elements. The antenna may include, for example, a phased array antenna, a single element antenna, a set of switched beam antennas, and/or the like.

The phrase "antenna array", as used herein, may refer to a plurality of antenna elements in any suitable configuration and/or arrangement.

The term "station" (STA), as used herein, may include any logical entity that is a singly addressable instance of a medium access control (MAC) and a physical layer (PHY) interface to a wireless medium (WM).

The phrases "directional multi-gigabit (DMG)" and "directional band" (DBand), as used herein, may relate to a frequency band wherein the Channel starting frequency is above 40 GHz.

The phrases "DMG STA" and "mmWave STA (mSTA)" may relate to a STA having a radio transmitter, which is operating on a channel that is within the DMG band.

The phrase "access point" (AP), as used herein, may include an entity that contains one station (STA) and provides access to distribution services, via the WM for associated STAs.

The term "beamforming", as used herein, may relate to a spatial filtering mechanism, which may be used at a transmitter and/or a receiver to improve the received signal power or signal-to-noise ratio (SNR) at an intended receiver.

The term "sector", as used herein, may relate to a transmit and/or a receive antenna pattern corresponding to a particular sector, e.g., a sector identifier (ID).

The term "sweep", as used herein, may relate to a sequence of transmissions, e.g., separated by a short beamforming inter frame space (SBIFS) interval, in which an antenna configuration at a transmitter and/or a receiver is changed between transmissions.

The phrase "sector sweep" (SSW), as used herein, may relate to a reception or a transmission of frames via different sectors, in which a sweep is performed between consecutive receptions and/or transmissions.

Reference is now made to FIG. 1, which schematically illustrates a block diagram of a wireless communication system 100, in accordance with some demonstrative embodiments.

In some demonstrative embodiments, system 100 may include one or more wireless communication devices, e.g., wireless communication devices 102 and/or 104, capable of communicating content, data, information and/or signals over at least one suitable wireless communication channel 114, for example, a radio channel, an IR channel, a RF channel, a Wireless Fidelity (WiFi) channel, and the like. In one example, channel 114 may include a DMG channel. One or more elements of system 100 may optionally be capable of communicating over any suitable wired communication links.

In some demonstrative embodiments, wireless communication devices 102 and/or 104 may include, for example, a PC, a desktop computer, a mobile computer, a laptop computer, a notebook computer, a tablet computer, an Ultrabook™ computer, a server computer, a handheld computer, a handheld device, a PDA device, a handheld PDA device, an on-board device, an off-board device, a hybrid device (e.g., combining cellular phone functionalities with PDA device functionalities), a consumer device, a vehicular device, a non-vehicular device, a mobile or portable device, a non-mobile or non-portable device, a mobile phone, cellular telephone, a handset, a PCS device, a PDA device which incorporates a wireless communication device, a mobile or portable GPS device, a DVB device, a relatively small computing device, a non-desktop computer, a "Carry Small Live Large" (CSLL) device, an Ultra Mobile Device (UMD), an Ultra Mobile PC (UMPC), a Mobile Internet Device (MID), an "Origami" device or computing device, a device that supports Dynamically Composable Computing (DCC), a context-aware device, a video device, an audio device, an A/V device, a Set-Top-Box (STB), a Blu-ray disc (BD) player, a BD recorder, a Digital Video Disc (DVD) player, a High Definition (HD) DVD player, a DVD recorder, a HD DVD recorder, a Personal Video Recorder (PVR), a broadcast HD receiver, a video source, an audio source, a video sink, an audio sink, a stereo tuner, a broadcast radio receiver, a flat panel display, a Personal Media Player (PMP), a digital video camera (DVC), a digital audio player, a speaker, an audio receiver, a gaming device, an audio amplifier, a data source, a data sink, a Digital Still camera (DSC), a media player, a Smartphone, a television, a music player, an AP, a base station, or the like.

In some demonstrative embodiments, wireless communication devices 102 and/or 104 may perform the functionality of DMG stations. For example, wireless communication devices 102 and/or 104 may be configured to communicate over the DMG band.

In other embodiments, wireless communication devices 102 and/or 104 may communicate over any other channel and/or according to any other technology, e.g., WiFi, Wimax, LTE, Bluetooth and/or any other technology.

In some demonstrative embodiments, wireless communication device 102 may include a radio 106, and wireless communication device 104 may include a radio 112 to perform wireless communication between wireless communication devices 102 and 104 and/or with one or more other wireless communication devices, e.g., as described below. Radios 106 and/or 112 may transmit and/or receive wireless communication signals, RF signals, frames, blocks, transmission streams, packets, messages, data items, and/or data. In one example, radios 106 and/or 112 may include or may be implemented as part of a wireless Network Interface Card (NIC), and the like.

In some demonstrative embodiments, devices 102 and/or 104 may communicate according to a beamforming scheme. For example, device 102 may include at least one antenna array 110, and device 104 may include at least one antenna array 108.

In some demonstrative embodiments, antenna arrays 108 and/or 110 may each include a plurality of antenna elements configured to simultaneously emit and/or receive signals in accordance with the beamforming scheme. For example, antenna arrays 108 and/or 110 may include a phased array antenna, or another form of antenna array.

In some demonstrative embodiments, antenna array 108 may perform the functionality of a transmit (Tx) antenna array and antenna array 110 may perform the functionality of a receive (Rx) antenna array. For example, antenna array 108 may be configured to form a beam directed in a particular direction of antenna array 110, e.g., by shifting phases of the signals emitted by the plurality of antenna elements of antenna 108. The phases of the signals emitted by the antenna elements may be shifted, for example, to provide a constructive and/or destructive interference configured to steer the beam in the particular direction. Antenna array 110 may be configured to receive the beam transmitted by antenna array 108, e.g., by shifting phases of the plurality of antenna elements of antenna 110, for example, to receive the steered beam from antenna array 108.

In some demonstrative embodiments, antenna array 110 may perform the functionality of a Tx antenna array and antenna array 108 may perform the functionality of an Rx antenna array. For example, antenna array 110 may be configured to form a beam directed in a particular direction of antenna array 108, e.g., by shifting phases of the signals emitted by the plurality of antenna elements of antenna 110. The phases of the signals emitted by the antenna elements may be shifted, for example, to provide a constructive and/or destructive interference configured to steer the beam in the particular direction. Antenna array 108 may be configured to receive the beam transmitted by antenna array 110, e.g., by shifting phases of the plurality of antenna elements of antenna 108, for example, to receive the steered beam from antenna array 110.

In some demonstrative embodiments, devices 102 and/or 104 may implement transmit and receive functionalities using separate transmit and receive antenna arrays. In other embodiments, devices 102 and/or 104 may implement transmit and receive functionalities using common and/or integrated transmit/receive elements. For example, antenna array 110 and/or antenna array 108 may perform the functionality of both transmit and receive antenna arrays, e.g., using common and/or integrated transmit/receive elements. Alternatively, antenna array 108 and/or antenna array 110 may implement transmit and receive functionalities using separate transmit and receive antenna elements.

In some demonstrative embodiments, devices 102 and/or 104 may include, or may be included as part of, for example, a PC, a desktop computer, a mobile computer, a laptop computer, a notebook computer, a tablet computer, an Ultrabook™ computer, a server computer, a handheld computer, a handheld device, a PDA device, a handheld PDA device, an on-board device, an off-board device, a hybrid device (e.g., combining cellular phone functionalities with PDA device functionalities), a consumer device, a vehicular device, a non-vehicular device, a mobile or portable device, a non-mobile or non-portable device, a cellular telephone, a PCS device, a PDA device which incorporates a wireless communication device, a mobile or portable GPS device, a DVB device, a relatively small computing device, a non-desktop computer, a "Carry Small Live Large" (CSLL) device, an Ultra Mobile Device (UMD), an Ultra Mobile PC (UMPC), a Mobile Internet Device (MID), an "Origami" device or computing device, a device that supports Dynamically Composable Computing (DCC), a context-aware device, a video device, an audio device, an A/V device, a STB, a BD player, a BD recorder, a DVD player, a HD DVD player, a DVD recorder, a HD DVD recorder, a PVR, a broadcast HD receiver, a video source, an audio source, a video sink, an audio sink, a stereo tuner, a broadcast radio receiver, a flat panel display, a PMP, a DVC, a digital audio player, a speaker, an audio receiver, a gaming device, an audio amplifier, a data source, a data sink, a DSC, a media player, a Smartphone, a television, a music player, or the like.

In some demonstrative embodiments, device 102 may also include, for example, one or more of a processor 118, an input unit 117, an output unit 105, a memory unit 109, and a storage unit 111. Device 102 may optionally include other suitable hardware components and/or software components. In some embodiments, some or all of the components of device 102 may be enclosed in a common housing or packaging, and may be interconnected or operably associated using one or more wired or wireless links. In other embodiments, components of device 102 may be distributed among multiple or separate devices or locations.

Processor 118 includes, for example, a Central Processing Unit (CPU), a Digital Signal Processor (DSP), one or more processor cores, a single-core processor, a dual-core processor, a multiple-core processor, a microprocessor, a host processor, a controller, a plurality of processors or controllers, a chip, a microchip, one or more circuits, circuitry, a logic unit, an Integrated Circuit (IC), an Application-Specific IC (ASIC), or any other suitable multi-purpose or specific processor or controller. Processor 118 executes instructions, for example, of an Operating System (OS) of wireless communication device 102 and/or of one or more suitable applications.

Input unit 117 includes, for example, a keyboard, a keypad, a mouse, a touch screen, a touch-pad, a track-ball, a stylus, a microphone, or other suitable pointing device or input device. Output unit 105 includes, for example, a monitor, a screen, a touch screen, a flat panel display, a Liquid Crystal Display (LCD) display unit, a plasma display unit, one or more audio speakers or earphones, or other suitable output devices.

Memory unit 109 includes, for example, a Random Access Memory (RAM), a Read Only Memory (ROM), a Dynamic RAM (DRAM), a Synchronous DRAM (SD-RAM), a flash memory, a volatile memory, a non-volatile memory, a cache memory, a buffer, a short term memory unit, a long term memory unit, or other suitable memory units. Storage unit 111 includes, for example, a hard disk drive, a floppy disk drive, a Compact Disk (CD) drive, a CD-ROM drive, a DVD drive, or other suitable removable or non-removable storage units. Memory unit 109 and/or storage unit 111, for example, may store data processed by wireless communication device 102.

In some demonstrative embodiments, device 102 may include a steering controller 130 to control steering of antenna array 110, e.g., as described in detail below.

In some demonstrative embodiments, steering controller 130 may be implemented as part of radio 106. For example, steering controller 130 may be implemented as part of a base-band (BB) of radio 106. In other embodiments, steering controller 130 may be implemented as part of any other element of device 102, e.g., any software, hardware and/or combination thereof.

In some demonstrative embodiments, steering controller 130 may control the steering of antenna array 110 according to a steering vector. The steering vector may represent a plurality of antenna weights, e.g., in the form of antenna weight vector, to be applied to the antenna elements of antenna array 110.

In some demonstrative embodiments, steering controller 130 may determine the steering vector as part of a beamforming process, which may be performed between a receiver side, e.g., one of devices 102 and 104, and a transmitter side, e.g., another one of devices 102 and 104.

In some demonstrative embodiments, steering controller 130 may determine the steering vector for steering antenna array 110 based on a channel estimation of a wireless communication channel between devices 102 and 104.

In some demonstrative embodiments, the channel estimation may be performed using an omni-directional antenna setting at the receiver side. For example, during the beamforming process, the receiver side may set the antenna array of the receiver side to an omni-directional mode to receive signals from the transmitter side. When operated at the omni-directional mode, the antenna array of the receiver side may be intended to receive the signals from the transmitter side in an isotropic manner, e.g., from all directions.

In some demonstrative embodiments, the channel estimation between devices 102 and 104 may be modeled by a time domain impulse response including a plurality of amplitudes corresponding to a plurality of timing taps (taps). The taps may represent, for example, taps of a discrete-time Finite-Impulse-Response (FIR) filter, which models the channel response. For example, the plurality of taps of the channel estimation may represent a plurality of reflections in system 100.

In some demonstrative embodiments, antenna array 110 may perform the functionality of an Rx antenna array, e.g., if device 102 performs the functionality of the receiver side. According to these embodiments, the channel estimation may be determined by device 102 based on signals received via antenna array 110. Steering controller 130 may steer, for example, antenna array 110 according to the steering vector determined based on the signals received via antenna array 110.

In some demonstrative embodiments, antenna array 110 may perform the functionality of a Tx antenna array, e.g., if device 102 performs the functionality of the transmitter side. According to these embodiments, the channel estimation may be determined by device 104 based on signals transmitted by device 102 via antenna array 110 and received by device 104 via antenna array 108. Device 102 may receive the channel estimation from device 104, and steering controller 130 may steer, for example, antenna array 110 according to the steering vector determined based on the channel estimation received from device 104.

In some demonstrative embodiments, determining the steering vector based on a tap of the channel estimation, which has a maximal amplitude ("the maximal-amplitude tap"), may provide beneficial results, e.g., maximal channel gain, in some scenarios, e.g., assuming that the omni-directional setting of the antenna array of the receiver side is optimal. For example, determining the steering vector based on the maximal-amplitude tap may provide beneficial results, e.g., if the maximal amplitude tap actually corresponds to a beamformed channel having a maximal gain.

However, an actual antenna response of the antenna array of the receiver side may differ from an isotropic angular response of an optimal omni-directional antenna. As a result, the channel estimation may be distorted. Accordingly, the maximal-amplitude tap of the channel estimation may be different from an optimal maximal-amplitude tap of an optimal channel estimation corresponding to an optimal omni-directional antenna.

Additionally or alternatively, even if the omni-directional mode of the receiver side may substantially function as an optimal omni-directional antenna, the maximal-amplitude tap may not always result in an optimal beamformed channel, e.g., a beamformed channel having an increased channel gain, e.g., a maximal channel gain.

In one example, the wireless communication channel between devices 102 and 104 may be affected by a plurality of reflections, e.g., including three strongest reflections. The three reflections may include a strongest reflection and two less-strong reflections, which are each weaker than the strongest reflection, while a total power of the less-strong reflections is greater than a power of the strongest reflection. The two less-strong reflections may be strongly spatially overlapped with one another, and may be orthogonal to the strongest reflection.

According to this example, steering antenna array 110 in a first direction based on a tap corresponding to one of the less-strong reflections may result in an increased power, e.g., compared to a power resulting from steering antenna array 110 in a second direction based on a tap corresponding to the strongest reflection.

In some demonstrative embodiments, steering controller 130 may be configured to select a first plurality of timing taps out of a second plurality of the timing taps of the channel estimation. In one embodiment, the first plurality of taps may include between two and ten taps of the plurality of taps of the channel estimation. For example, the first plurality of taps may include between four and eight taps of the plurality of taps of the channel estimation, e.g., five taps. In other embodiments, the first plurality of taps may include any other number of taps.

In some demonstrative embodiments, steering controller 130 may be configured to select the first plurality of timing taps to include timing taps ("the plurality of highest-amplitude tap") having highest amplitudes of the second plurality of timing taps of the channel estimation. For example, steering controller 130 may select the five taps having the highest amplitude. In other embodiments, steering controller 130 may select the first plurality of taps according to any other selection criterion. For example, steering controller 130 may select the first plurality of timing taps to include taps having an amplitude within predefined range, e.g., all timing taps with an amplitude within a predefined range, e.g., 5 decibel (dB), from the amplitude of the maximal amplitude tap.

In some demonstrative embodiments, selecting the first plurality of timing taps from the second plurality of taps of the channel estimation may increase the probability of determining the steering vector, which may result in a beamformed link having maximal channel gain, e.g., compared to the probability, if the steering vector is determined based on a single tap, e.g., the maximal-amplitude tap.

In some demonstrative embodiments, steering controller 130 may be configured to determine a plurality of steering vectors corresponding the first plurality of timing taps.

In one embodiment, steering controller 130 may determine the plurality of steering vectors by determining a plurality of un-normalized steering vectors corresponding to the plurality of taps. The un-normalized steering vectors may be determined, for example, using a power method, e.g., which may determine an un-normalized steering vector corresponding to a particular tap, e.g., by optimizing a power output at antenna array 110 with respect to the particular tap. The un-normalized steering vectors may be determined using any other method and/or algorithm.

In some demonstrative embodiments, steering controller 130 may be configured to determine a particular steering vector for controlling antenna array 110 based on the plurality of steering vectors corresponding to the selected plurality of timing taps.

In some demonstrative embodiments, steering controller 130 may be configured to determine the particular steering vector by selecting the particular steering vector from the plurality of steering vectors corresponding to the selected plurality of timing taps, e.g., as described below.

In some demonstrative embodiments, steering controller 130 may be configured to determine a plurality of metric values corresponding to the plurality of steering vectors.

In some demonstrative embodiments, steering controller 130 may determine the particular steering vector based on a comparison between the plurality of metric values, e.g., as described below.

In some demonstrative embodiments, a metric value, denoted $D_n$, may be determined corresponding to an n-th steering vector, denoted Ugal(n), wherein n=1 . . . M, and wherein M denotes the number of the steering vectors corresponding to the first plurality of selected taps. The steering vector Ugal(n) may include, for example, a number of vector elements equal to the number of antenna elements of antenna array 110.

In some demonstrative embodiments, the metric value $D_n$ corresponding to the n-th steering vector may be defined based on the n-th steering vector and independently of other steering vectors of the plurality of steering vectors.

In one embodiment, the metric value $D_n$ may be determined, for example, as follows:

$$D_n = \text{sum}(abs(Ugal(n)\cdot\hat{}\,\text{alpha}) \quad (1)$$

wherein alpha denotes a predefined parameter, e.g., as described below.

In some demonstrative embodiments, steering controller 130 may control antenna array 110 according to a full modulation antenna-weighting scheme. For example, steering controller 130 may control antenna array 110 according an antenna weight vector, which is based on both phase and amplitude of the selected steering vector.

According to these embodiments, the parameter alpha may be defined as alpha=2, e.g., to define the metric the metric value $D_n$ to take into consideration both the phase and the amplitude of the n-th steering vector Ugal(n).

In some demonstrative embodiments, steering controller 130 may control antenna array 110 according to a partial modulation antenna-weighting scheme. For example, steering controller 130 may control antenna array 110 according an antenna weight vector, which is based on the phase of the selected steering vector. For example, steering controller may determine the antenna weight vector, denoted AWV, e.g., as follows:

$$\text{AWV} = \text{phase}(Ugal(n_s)) \quad (2)$$

wherein Ugal($n_s$) denotes the selected steering vector.

According to these embodiments, the parameter alpha may be defined as alpha=1, e.g., to define the metric the metric value $D_n$ considering only the phase of the n-th steering vector Ugal(n).

In some demonstrative embodiments, steering controller 130 may be configured to determine the particular steering vector based on a combination of two or more steering vectors from the plurality of steering vectors corresponding to the selected plurality of timing taps, e.g., as described below.

In some demonstrative embodiments, the metric value corresponding to the n-th steering vector may be defined based on a plurality of overlap coefficients between the n-th steering vector and other steering vectors of the plurality of steering vectors. For example, an overlap coefficient corresponding to the n-th steering vector may be based on the n-th steering vector and one of the other steering vectors.

In some demonstrative embodiments, a metric value, denoted ChG(n), may be determined corresponding to the n-th steering vector, for example, based on the metric values $D_n$ corresponding to two or more of the selected plurality of taps, e.g., to all taps of the selected plurality of taps.

In one example, the metric value ChG(n) may be determined, for example, as follows:

$$ChG(n) = D_1^2 R_{n1} + D_2^2 R_{n2} + \ldots + D_M^2 R_{nM} \quad (3)$$

wherein $R_{nm}$ denotes an overlap coefficient between the n-th steering vector and the m-th steering vector, m=1 . . . M.

For example, the overlap coefficient $R_{nm}$ may be determined, for example, as follows, e.g., if steering controller 130 is to control antenna array 110 according to the partial modulation antenna-weighting scheme:

$$R_{nm}=abs(Ugal(n)*Ugal(m))^2 \quad (4)$$

For example, the overlap coefficient $R_{nm}$ may be determined as follows, e.g., if steering controller 130 is to control antenna array 110 according to the full modulation antenna-weighting scheme:

$$R_{nm}=abs(\text{phase}(Ugal(n)*Ugal(m)))^2 \quad (5)$$

In other embodiments, the metric value and/or overlap coefficient may be determined based on any other calculation.

In some demonstrative embodiments, steering controller 130 may determine the antenna weight vector based on the selected steering vector. For example, steering controller 130 may determine a normalized steering vector based on the selected un-normalized steering vector.

In some demonstrative embodiments, the normalized steering vector resulting from the selected steering vector corresponding to the particular timing tap may represent antenna weights to be applied to antenna array 110 with respect to the particular timing tap.

In some demonstrative embodiments, steering controller 130 may select the steering vector, e.g., as described above, to result in a highest value of at least one channel-related metric of all values of the channel-related metric resulting from the steering vectors corresponding to the selected plurality of taps. The channel related metric may include, for example, a channel gain, a channel peak, a Signal to noise Ratio (SNR), e.g., a Post Processing SNR (PPSNR), which may depend on the SNR and the channel, and/or any other metric.

In some demonstrative embodiments, steering controller 130 may select the steering vector corresponding to the highest metric value $D_n$.

In some demonstrative embodiments, selecting the steering vector corresponding to the highest metric value $D_n$ may result in a beamformed channel having an increased gain, e.g., the strongest gain, amongst all beamformed channels, which may be obtained by selecting steering vectors corresponding to other timing taps.

In some demonstrative embodiments, the steering vector corresponding to the highest metric value $D_n$ may include the steering vector corresponding to the maximal-amplitude tap in some scenarios, e.g., if the channel estimation is performed without substantially distorting the "ideal" omni-directional response of antenna array 110.

In some demonstrative embodiments, the steering vector corresponding to the highest metric value $D_n$ may include the steering vector corresponding to a tap other than the maximal-amplitude tap, e.g., if the channel estimation is distorted with respect to the "ideal" omni-directional response of antenna array 110.

In some demonstrative embodiments, selecting the steering vector corresponding to the highest metric value ChG(n) may result in a beamformed channel having an increased gain, e.g., the strongest gain, and/or improved PPSNR, e.g., best PPSNR, amongst all beamformed channels, which may be obtained by selecting steering vectors corresponding to other timing taps.

In some demonstrative embodiments, selecting the steering vector corresponding to the highest metric value ChG(n) may maximize channel gain, for example, since the metric ChG(n) may utilize relations, e.g., spatial overlapping, between the strongest taps, which may be interpreted as physical reflections. For example, if system 100 includes the three main reflections as described above, selecting the steering vector corresponding to the highest metric value ChG(n) may result in a beam directed according to one of the less-strong taps, which may result in maximal channel gain.

Figure 2:
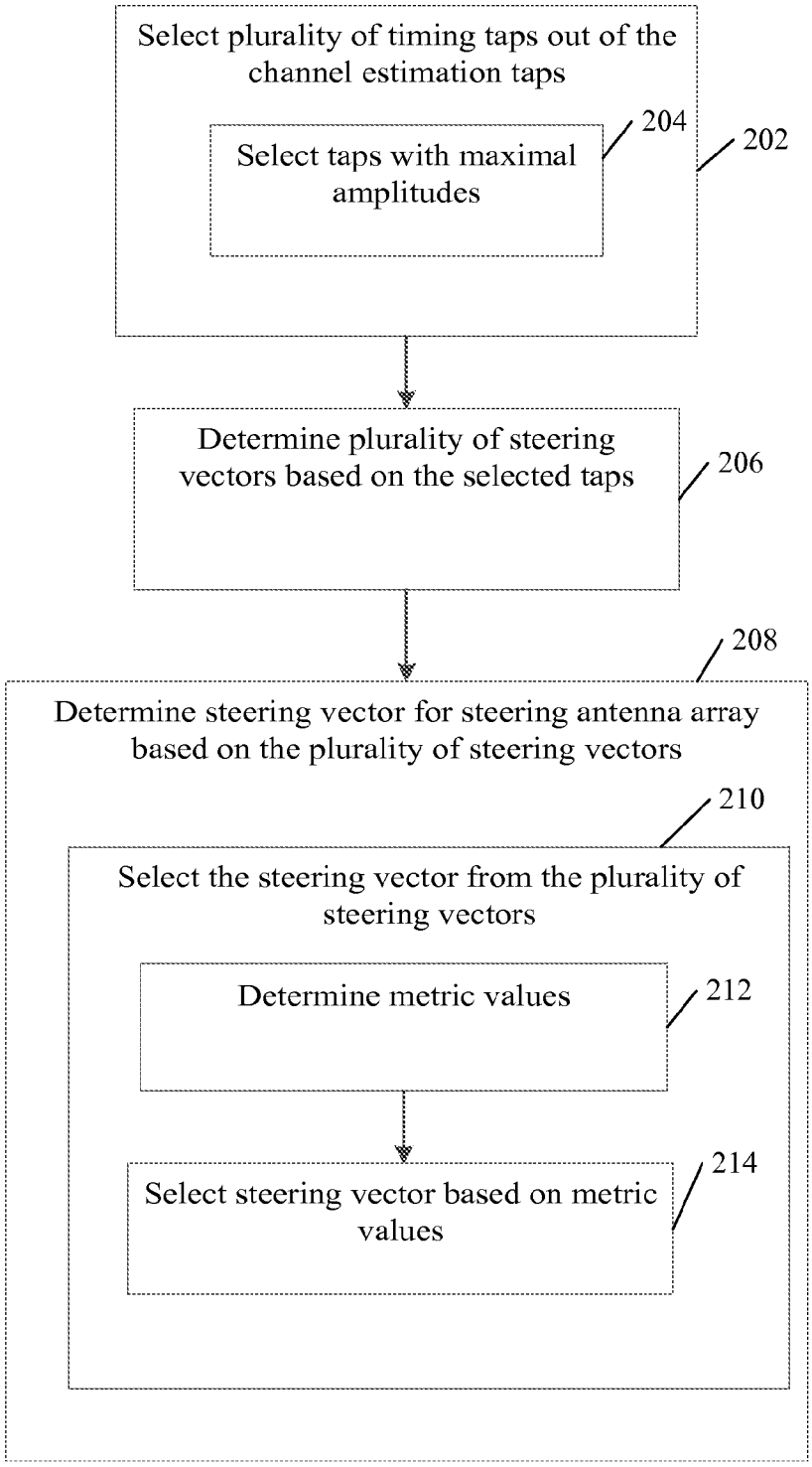
FIG. 2 is a schematic illustration of a method of steering an antenna array, in accordance with some demonstrative embodiments.

Reference is made to FIG. 2, which schematically illustrates a method of steering an antenna array, in accordance with some demonstrative embodiments. In some demonstrative embodiments, one or more of the operations of the method of FIG. 2, may be performed by a wireless communication system, e.g., system 100 (FIG. 1); a wireless communication device, e.g., device 102 (FIG. 1); a radio, e.g., radio 106 (FIG. 1); and/or a steering controller, e.g., steering controller 130 (FIG. 1).

As indicated at block 202, the method may include selecting a first plurality of timing taps out of a second plurality of timing taps of a channel estimation of a wireless communication channel. For example, steering controller 130 (FIG. 1) may select a first plurality of timing taps out of a second plurality of timing taps of a channel estimation corresponding to the wireless communication channel between devices 102 (FIG. 1) and 104 (FIG. 1), e.g., as described above.

As indicated at block 204, selecting the first plurality of timing taps may include, for example, selecting the first plurality of timing taps to include timing taps having highest amplitudes of the second plurality of timing taps. For example, steering controller 130 (FIG. 1) may select a predefined number of taps having the highest amplitudes of the channel estimation, e.g., as described above.

As indicated at block 206, the method may include determining a plurality of steering vectors corresponding to the first plurality of timing taps. For example, steering controller 130 (FIG. 1) may determine the plurality of steering vectors corresponding to the selected plurality of timing taps, e.g., as described above.

As indicated at block 208, the method may include determining a particular steering vector based on the plurality of steering vectors for steering an antenna array, e.g., to form a beamformed link over the wireless communication channel. For example, steering controller 130 (FIG. 1) may determine the steering vector for steering antenna array 110 (FIG. 1) based on the plurality of steering vectors, e.g., as described above.

As indicated at block 210, determining the particular steering vector may include selecting the particular steering vector from the plurality of steering vectors. For example, steering controller 130 (FIG. 1) may select the steering vector from the plurality of steering vectors, e.g., as described above.

As indicated at block 212, determining the particular steering vector may include determining a plurality of metric values corresponding to the plurality of steering vectors. For example, steering controller 130 (FIG. 1) may determine the plurality of metric values corresponding to the plurality of steering vectors, e.g., as described above.

As indicated at block 214, determining the particular steering vector may include selecting the particular steering vector based on the plurality of metric values. For example, steering controller 130 (FIG. 1) may select the steering vector having the highest metric value, e.g., as described above.

Figure 3:
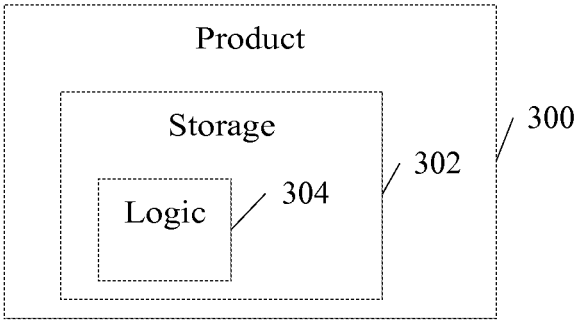
FIG. 3 is a schematic illustration of a product of manufacture, in accordance with some demonstrative embodiments.

Reference is made to FIG. 3, which schematically illustrates a product of manufacture 300, in accordance with some demonstrative embodiments. Product 300 may include a non-transitory machine-readable storage medium 302 to store logic 304, which may be used, for example, to perform at least part of the functionality of device 102 (FIG. 1), radio 106 (FIG. 1), and/or steering controller 130 (FIG. 1) and/or to perform one or more operations of the method of FIG. 2. The phrase "non-transitory machine-readable medium" is directed to include all computer-readable media, with the sole exception being a transitory propagating signal.

In some demonstrative embodiments, product 300 and/or machine-readable storage medium 302 may include one or more types of computer-readable storage media capable of storing data, including volatile memory, non-volatile memory, removable or non-removable memory, erasable or non-erasable memory, writeable or re-writeable memory, and the like. For example, machine-readable storage medium 302 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), Compact Disk ROM (CD-ROM), Compact Disk Recordable (CD-R), Compact Disk Rewriteable (CD-RW), flash memory (e.g., NOR or NAND flash memory), content addressable memory (CAM), polymer memory, phase-change memory, ferroelectric memory, silicon-oxide-nitride-oxide-silicon (SONOS) memory, a disk, a floppy disk, a hard drive, an optical disk, a magnetic disk, a card, a magnetic card, an optical card, a tape, a cassette, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative embodiments, logic 304 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative embodiments, logic 304 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, such as C, C++, Java, BASIC, Matlab, Pascal, Visual BASIC, assembly language, machine code, and the like.

Functions, operations, components and/or features described herein with reference to one or more embodiments, may be combined with, or may be utilized in combination with, one or more other functions, operations, components and/or features described herein with reference to one or more other embodiments, or vice versa.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

What is claimed is:

1. An apparatus comprising:

a steering controller comprising a processor configured to control steering of an antenna array, said steering controller is configured to select a first plurality of timing taps out of a second plurality of timing taps of a channel estimation, to determine a plurality of steering vectors corresponding to said first plurality of timing taps, to determine a particular steering vector based on phases of said plurality of steering vectors, and to control steering of said antenna array according to said particular steering vector, said steering controller is configured to determine an antenna weight vector for steering said antenna array based on a phase of said particular steering vector.

2. The apparatus of claim 1, wherein said steering controller is to determine said particular steering vector by selecting said particular steering vector from said plurality of steering vectors.

3. The apparatus of claim 2, wherein said steering controller is to determine a plurality of metric values corresponding to said plurality of steering vectors, and to select said particular steering vector based on said plurality of metric values.

4. An apparatus comprising:

a steering controller comprising a processor configured to control steering of an antenna array, said steering controller is configured to select a first plurality of timing taps out of a second plurality of timing taps of a channel estimation, to determine a plurality of steering vectors corresponding to said first plurality of timing taps, to determine a plurality of metric values corresponding to said plurality of steering vectors, and to select a particular steering vector based on said plurality of metric values, wherein a particular metric value corresponding to said particular steering vector is defined based on said particular steering vector and independently of other steering vectors of said plurality of steering vectors, said steering controller is configured to control steering of said antenna array according to said particular steering vector.

5. An apparatus comprising:

a steering controller comprising a processor configured to control steering of an antenna array, said steering controller is configured to select a first plurality of timing taps out of a second plurality of timing taps of a channel estimation, to determine a plurality of steering vectors corresponding to said first plurality of timing taps, to determine a plurality of metric values corresponding to said plurality of steering vectors, and to determine a particular steering vector based on said plurality of metric values, wherein a particular metric value corresponding to said particular steering vector is defined based on a combination of said plurality of steering vectors, said steering controller is configured to control steering of said antenna array according to said particular steering vector.

6. The apparatus of claim 5, wherein said particular metric value is defined based on a plurality of overlap coefficients between said particular steering vector and other steering vectors of said plurality of steering vectors, wherein a particular overlap coefficient is based on said particular steering vector and one of said other steering vectors.

7. The apparatus of claim 4, wherein said steering controller is to select said first plurality of timing taps to include timing taps having highest amplitudes of said second plurality of timing taps.

8. An apparatus comprising:

a steering controller comprising a processor configured to control steering of an antenna array, said steering controller is configured to select a first plurality of timing taps out of a second plurality of timing taps of a channel estimation, to determine a plurality of steering vectors corresponding to said first plurality of timing taps, to determine a particular steering vector based on both a phase and an amplitude of said plurality of steering vectors, and to control steering of said antenna array according to said particular steering vector, said steering controller is configured to determine an antenna weight vector for steering said antenna array based on both a phase and an amplitude of said particular steering vector.

9. The apparatus of claim 8, wherein said steering controller is to select said first plurality of timing taps to include timing taps having highest amplitudes of said second plurality of timing taps.

10. The apparatus of claim 1, wherein said particular vector results in a highest value of at least one channel-related metric of all values of said channel-related metric resulting from steering vectors corresponding to said second plurality of taps, said at least one channel related metric comprises at least one metric selected from the group consisting of channel gain, channel peak, Signal to noise Ratio (SNR), and Post Processing SNR (PPSNR).

11. The apparatus of claim 1, wherein said channel estimation is based on signals received via a receive (Rx) antenna array, and wherein said steering controller is to steer said Rx antenna array according to said particular steering vector.

12. The apparatus of claim 1, wherein said channel estimation is received from another device, and wherein said steering controller is to steer a Transmit (Tx) antenna array according to said particular steering vector.

13. A system comprising:

a wireless communication device including:

an antenna array; and a steering controller comprising a processor configured to control steering of said antenna array for communicating via a beamformed link over a wireless communication channel, said steering controller is configured to select a first plurality of timing taps out of a second plurality of timing taps of a channel estimation corresponding to said wireless communication channel, to determine a plurality of steering vectors corresponding to said first plurality of timing taps, to determine a particular steering vector based on phases of said plurality of steering vectors, and to control steering of said antenna array according to said particular steering vector, said steering controller is configured to determine an antenna weight vector for steering said antenna array based on a phase of said particular steering vector.

14. The system of claim 13, wherein said steering controller is to determine said particular steering vector by selecting said particular steering vector from said plurality of steering vectors.

15. The system of claim 14, wherein said steering controller is to determine a plurality of metric values corresponding to said plurality of steering vectors, and to select said particular steering vector based on said plurality of metric values.

16. A system of comprising:

a wireless communication device including:

an antenna array; and a steering controller comprising a processor configured to control steering of said antenna array for communicating via a beamformed link over a wireless communication channel, said steering controller is configured to select a first plurality of timing taps out of a second plurality of timing taps of a channel estimation corresponding to said wireless communication channel, to determine a plurality of steering vectors corresponding to said first plurality of timing taps, to determine a plurality of metric values corresponding to said plurality of steering vectors, and to select a particular steering vector based on said plurality of metric values, wherein a particular metric value corresponding to said particular steering vector is defined based on said particular steering vector and independently of other steering vectors of said plurality of steering vectors, said steering controller is configured to control steering of said antenna array according to said particular steering vector.

17. A system comprising:

a wireless communication device including:

an antenna array; and a steering controller comprising a processor configured to control steering of said antenna array for communicating via a beamformed link over a wireless communication channel, said steering controller is configured to select a first plurality of timing taps out of a second plurality of timing taps of a channel estimation corresponding to said wireless communication channel, to determine a plurality of steering vectors corresponding to said first plurality of timing taps, to determine a plurality of metric values corresponding to said plurality of steering vectors, and to select a particular steering vector based on said plurality of metric values, wherein a particular metric value corresponding to said particular steering vector is defined based on a combination of said plurality of steering vectors, said steering controller is configured to control steering of said antenna array according to said particular steering vector.

18. The system of claim 17, wherein said particular metric value is defined based on a plurality of overlap coefficients between said particular steering vector and other steering vectors of said plurality of steering vectors, wherein a particular overlap coefficient is based on said particular steering vector and one of said other steering vectors.

19. The system of claim 16, wherein said steering controller is to select said first plurality of timing taps to include timing taps having highest amplitudes of said second plurality of timing taps.

20. A system comprising:

a wireless communication device including:

an antenna array; and a steering controller comprising a processor configured to control steering of said antenna array for communicating via a beamformed link over a wireless communication channel, said steering controller is configured to select a first plurality of timing taps out of a second plurality of timing taps of a channel estimation corresponding to said wireless communication channel, to determine a plurality of steering vectors corresponding to said first plurality of timing taps, to determine a particular steering vector based on both a phase and an amplitude of said plurality of steering vectors, and to control steering of said antenna array according to said particular steering vector, said steering controller is configured to determine an antenna weight vector for steering said antenna array based on both a phase and an amplitude of said particular steering vector.

21. The system of claim 20, wherein said steering controller is to select said first plurality of timing taps to include timing taps having highest amplitudes of said second plurality of timing taps.

22. The system of claim 13, wherein said particular vector results in a highest value of at least one channel-related metric of all values of said channel-related metric resulting from steering vectors corresponding to said second plurality of taps, said at least one channel related metric comprises at least one metric selected from the group consisting of channel gain, channel peak, Signal to noise Ratio (SNR), and Post Processing SNR (PPSNR).

23. A method to be performed at a wireless communication device, the method comprising:

selecting by the wireless communication device a first plurality of timing taps out of a second plurality of timing taps of a channel estimation of a wireless communication channel;

determining by the wireless communication device a plurality of steering vectors corresponding to said first plurality of timing taps;

determining by the wireless communication device a plurality of metric values corresponding to said plurality of steering vectors; and determining by the wireless communication device a particular steering vector based on said plurality of metric values for steering an antenna array to form a beamformed link over said wireless communication channel according to said particular steering vector, wherein a particular metric value corresponding to said particular steering vector is based on said particular steering vector and independently of other steering vectors of said plurality of steering vectors.

24. The method of claim 23, wherein determining said particular steering vector comprises selecting said particular steering vector from said plurality of steering vectors.

25. The method of claim 23 comprising selecting said first plurality of timing taps to include timing taps having highest amplitudes of said second plurality of timing taps.

26. A method to be performed at a wireless communication device, the method comprising:

selecting by the wireless communication device a first plurality of timing taps out of a second plurality of timing taps of a channel estimation of a wireless communication channel;

determining by the wireless communication device a plurality of steering vectors corresponding to said first plurality of timing taps;

determining by the wireless communication device a plurality of metric values corresponding to said plurality of steering vectors; and determining by the wireless communication device a particular steering vector based on said plurality of metric values for steering an antenna array to form a beamformed link over said wireless communication channel according to said particular steering vector, wherein a particular metric value corresponding to said particular steering vector is defined based on a combination of said plurality of steering vectors.

27. The method of claim 26 comprising selecting said first plurality of timing taps to include timing taps having highest amplitudes of said second plurality of timing taps.

28. A product including a non-transitory storage medium having stored thereon instructions that, when executed by a machine, result in performing operations at a wireless communication device, the operations comprising:

selecting a first plurality of timing taps out of a second plurality of timing taps of a channel estimation of a wireless communication channel;

determining a plurality of steering vectors corresponding to said first plurality of timing taps;

determining a particular steering vector based on phases of said plurality of steering vectors for steering an antenna array to form a beamformed link over said wireless communication channel according to said particular steering vector; and determining an antenna weight vector for steering said antenna array based on a phase of said particular steering vector.

29. The product of claim 28, wherein determining said particular steering vector comprises selecting said particular steering vector from said plurality of steering vectors.

30. The product of claim 29, wherein said instructions result in:

determining a plurality of metric values corresponding to said plurality of steering vectors; and selecting said particular steering vector based on said plurality of metric values.

* * * * *